United States Patent [19]

Achelpohl et al.

[11] 4,162,025

[45] Jul. 24, 1979

[54] APPARATUS FOR UNREELING VALVED SACKS WHICH ARE REELED IN OVERLAPPING FORMATION

[75] Inventors: Fritz Achelpohl; Konrad Tetenborg; Richard Feldkämper, all of Lengerich of Westphalia, Fed. Rep. of Germany

[73] Assignee: Windmoller & Holscher, Lengerich of Westphalia, Fed. Rep. of Germany

[21] Appl. No.: 860,633

[22] Filed: Dec. 14, 1977

[30] Foreign Application Priority Data

Dec. 22, 1976 [DE] Fed. Rep. of Germany ..... 2658294

[51] Int. Cl.[2] ..... B65H 5/28

[52] U.S. Cl. ..... 221/72; 242/75.1; 221/277

[58] Field of Search ..... 221/277, 72, 73; 242/75.1

[56] References Cited

U.S. PATENT DOCUMENTS

| | | | |
|---|---|---|---|
| 2,471,055 | 5/1949 | Asbill, Jr. | 194/4 F |
| 3,061,225 | 10/1962 | Huck | 242/75.1 |
| 4,069,944 | 1/1978 | Achelpohl | 221/72 |

FOREIGN PATENT DOCUMENTS

| | | | |
|---|---|---|---|
| 689699 | 4/1965 | Italy | 221/73 |

*Primary Examiner*—Allen N. Knowles
*Attorney, Agent, or Firm*—Fleit & Jacobson

[57] ABSTRACT

In an apparatus for separating flattened valved sacks which are reeled in an overlapping formation, the reel is turned by endless belts pressing on the reel periphery as the overlapping sacks are being taken off the reel. A roller presses the overlapping sack formation onto the belts and this roller is disposed at a spacing of no more than about one sack length from the point where the sacks leave the reel.

7 Claims, 3 Drawing Figures

APPARATUS FOR UNREELING VALVED SACKS WHICH ARE REELED IN OVERLAPPING FORMATION

The invention relates to an apparatus for separating valved sacks stored in overlapping formation on reels and to be supplied to filling machines, comprising a stand in which pivotable arms with bearings for receiving the reel are mounted, a frame which can be applied to the reel and carries at opposite ends rollers over which there pass driven endless belts pressing on the reel periphery to drive the reel, spools for coiling holding bands that are pulled off together with the unreeled overlapping sacks, and conveyor means which are disposed downstream of the reel-driving belts, move at a higher speed and pull the sacks individually from the overlapping formation, according to U.S. Pat. No. 4,069,944.

In the apparatus according to the parent patent, the storage reel consisting of the reel of overlapping sacks is, during unreeling, set into rotation in synchronism with the withdrawn overlapping sacks so that the sacks to be separated can be taken away in an overlapping formation. When the storage reel that is to be unreeled consists of an overlapping coil of paper sacks, it is possible for the glue exuding from the base of these sacks to adhere the sack that has just been reeled during formation of the storage reel to one of the sacks of the preceding layer. Consequently, this sack will remain stuck during unreeling of the storage reel and will impede or interrupt the continuous withdrawal of the overlapping sacks.

It is therefore a problem of the present invention to improve the apparatus of the parent patent in such a way that it will also enable the trouble-free unreeling of storage reels of paper sacks.

According to the invention, this problem is solved in that a roller pressing the overlapping sack formation against the endless belts is disposed at a spacing of no more than about one length of the sacks to be unreeled from the point where the overlapping sacks are just being lifted off the reel. Since the storage reel to be unreeled consists of a coiled band of overlapping sacks, in which each rear end of the last sack is covered by the following sack, the leading end of each sack being unreeled will be covered by the preceding sack. During unreeling, the sacks will push the respective following sacks out of the storage reel, thereby forming an overlapping band corresponding to the reeled overlapping band. In the apparatus according to the invention, the roller pressing on the overlapping band creates an increased frictional force between the sack that is just being unreeled and the two sacks enveloping same as well as the endless belts, so that the individual sacks can be withdrawn from the storage reel without upsetting a uniform overlapping formation even if the exposed ends are stuck to the reel. The spacing of the roller from the unreeling point on the storage reel where the sacks leave the reel should not markedly exceed one sack length because otherwise the frictional contact between any sacks that are stuck to the reel will become too little and the unpeeling effect resulting from pressing the overlapping band away from the storage reel will become too low in order also to withdraw from the storage reel sacks that are stuck on.

The roller can press on the unreeled band of overlapping sacks under its own weight or be additionally loaded by a spring.

Desirably, the roller presses on the direction-changing roller disposed on the downstream side of the frame.

During unreeling of the storage reel, its diameter decreases from an initially maximum size to a minimum remnant. To compensate for the increasing spacing between the storage reel and the pressure roller, which would cause the sacks withdrawn towards the end no longer to be engaged by the pressure roller, the storage reel is pivotable on the pivotable arms against the belts during withdrawal of the overlapping band.

To control the pivotal motion of the pivotable arms, switches are mounted on the roller-carrying frame, the switching positions of the switches being disposed in planes which keep the applying motion of the roller-carrying frame within close limits. When the diameter of the storage reel decreases and the roller-carrying frame has thereby reached the one limit, the pivotable arms are advanced towards the roller-carrying frame until the frame has signalled that the other limit has been reached by operating the second switch.

In the case of a storage reel at a fixed location, the belts according to the parent patent can be swung against the storage reel on the roller-carrying frame. Desirably, the pressure roller is movably mounted relatively to the belts in such a way that the spacing between the point of contact of the band with the storage reel and the pressure roller remains constant.

Preferably, the pressure roller is mounted on guide carriages guided in guide tracks.

In a development of the invention, the guide tracks are fixed with respect to the stand so that the construction of the apparatus is simple.

In a further development of the invention, the guide tracks are connected to pivotable levers which are pivoted at positions fixed with respect to the stand and which are movable in dependence on the pivotal motion of the roller-carrying frame. This gives a short construction for the apparatus.

Desirably, driving levers connected to the roller-carrying frame lie against the pivotable levers so that the construction of the short form of the apparatus will be simple.

An example is illustrated in the drawing and will now be described in more detail. In the drawing.

Figure 1:
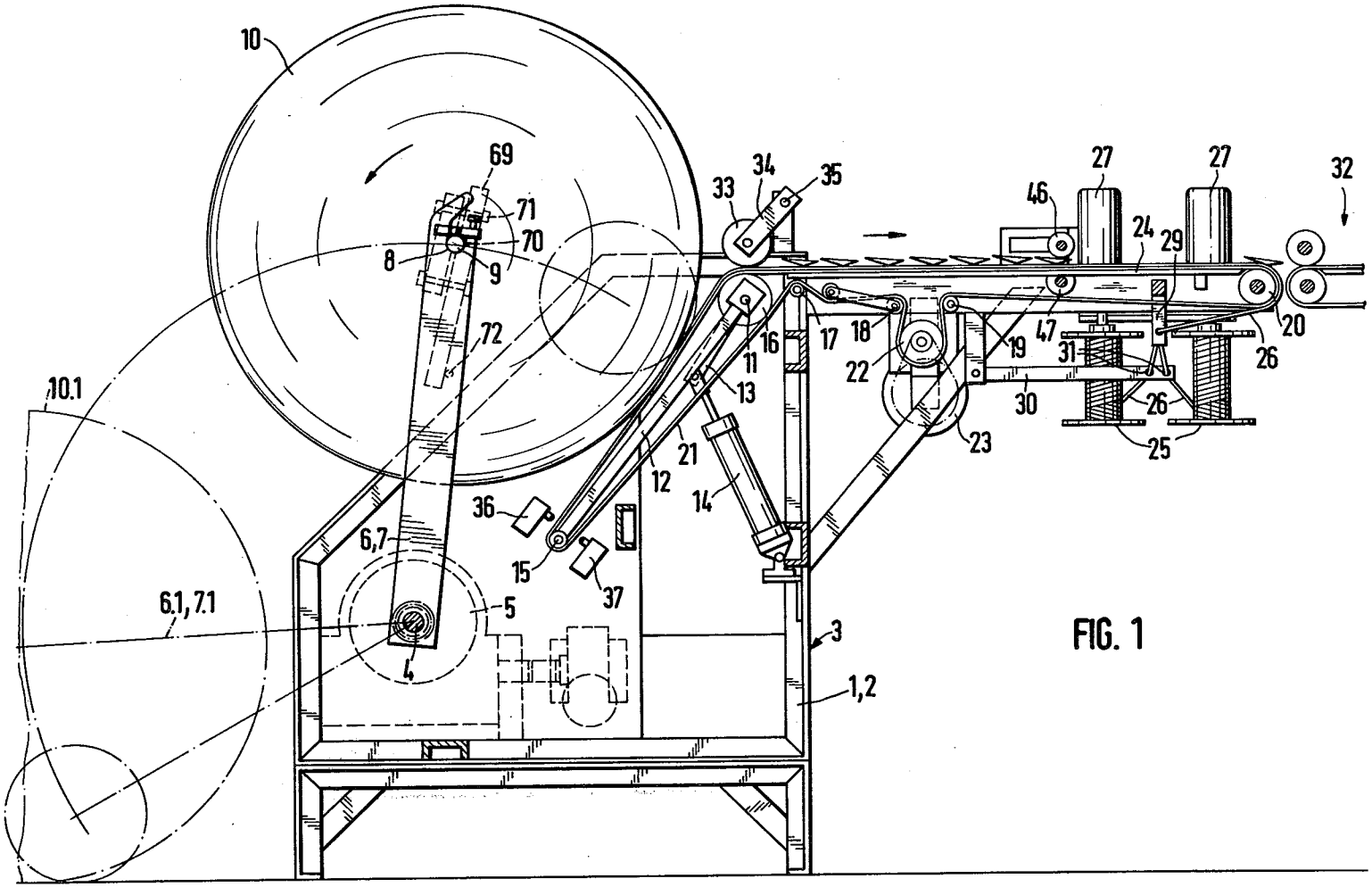
FIG. 1 is a side elevation in which the front side portion of the stand is omitted and in which a pressure roller at a fixed location can be pressed against a roller guiding the belts.

FIG. 1 shows an apparatus similar to that of the parent patent, comprising a stand 3 which is formed from two side members 1 and 2 and in which there is rotatably mounted a shaft 4 which can be self-lockingly rotated by a gear motor 5 secured to the stand 3. Arms 6 and 7 are mounted on the shaft 4 that have receiving emplacements 8 at their end. The arms 6, 7 can be swung substantially to a position 6.1 or 7.1 at which the receiving emplacements 8 engage a shaft 9 fitted in a storage reel 10 in the 10.1 position of the storage reel 10 and lift the storage reel 10 to the unreeling position shown in full lines by turning the shaft 4. Mounted on the shaft 9 there is a rotary brake 69 which consists of two segments similar to a Prony brake, the segments having semi-circular recesses 70 fitting over the shaft 9 and covered with a material that resembles brake lining. The two segments are pressed against the shaft 9 by means of bolts 71. Fixed to the stand 3 or one of the arms 6 or 7 there is a pin 72 against which one segment of the rotary brake 69 abuts. In this way the force corresponding to the torque is transmitted to the stand 3 or one of the arms 6 or 7. By turning the bolt 71, the torque of the brake can be adjusted.

Also rotatably mounted in the stand 3 there is a shaft 11 to which there are secured a frame 12 consisting of two arms 13. Pivoted to the arms 13 there are the piston rods of piston-cylinder pressure units 14 of which the cylinders are hinged to the stand 3.

Guide rollers 16 to 20 are rotatably mounted in the stand 3 and a guide roller 15 is rotatably mounted on the arm 12. Conveyor belts 21 are passed therethrough and, together with the guide rollers 15, 16, form a drive member for the storage reel 10. The conveyor belts 21 also pass over a roller 22 which is driven by a gear motor 23. By means of the piston-cylinder pressure units 14, the belts 21 are pressed against the storage reel 10 in the region between the guide rollers 15 and 16. The guide roller 16 is rotatably mounted on the shaft 11 and at the same time serves to guide the runs of the conveyor belts 21 leading to the storage reel and the runs coming off the storage reel. Near the guide rollers 16 and 20, the overlapping sacks are kept from sagging by a table 24 which is recessed beneath those runs of the conveyor belts 21 that come off the storage reel 10. Spools 25 for coiling the holding bands 26 withdrawn from the storage reel 10 are provided on the stand 3 and are driven by rotary field magnets 27.

The holding bands 26 are deflected downwardly over the guide rollers 20. Beneath the table 24 there are two band guide plates 29 each having a guide hole through which one of the holding bands 26 is passed and deflected through about 90° towards the spools 25. Further, there is an oscillatable guide rod 30 adjacent the spools 25, the front end of the rod containing two holes 31 through which the holding bands 26 pass to the spools 25. The gear motor 23 drives a cam plate (not shown) by means of which an oscillating motion of the guide rod 30 is achieved in conformity with the feeding of the conveyor belts 21. In this way the holding bands 26 are evenly coiled on the spools 25 over their length.

In line with the conveyor belts 21 leading to the guide roller 20 there are further belt guides of which only the belt guide 32 is illustrated. They move more rapidly than the conveyor belts 21 so that the sacks arriving on the conveyor belts 21 in overlapping formation are separated on the belt guide 32, whereafter the sacks lie side-by-side and can be engaged by the grippers of the automatic sack-placing machinery.

Above the guide roller 16 there is a pressure roller 33 which is rotatably mounted in lugs 34 at both sides. The lugs 34 are fixed by their other ends to a shaft 35 which is rotatably mounted in bearings that are fixed with respect to the stand.

The pressure roller 33 presses the overlapping sacks that are withdrawn from the storage reel 10 onto the belts 21 or the guide roller 16, this being done either under the weight of the pressure roller or by the force of a spring or the like so that the overlapping sacks will move in synchronism with the belts 21 and can be withdrawn from the storage reel 10 without being impeded or interrupted.

Two limiting switches 36, 37 are provided on the stand 3, their switch rods being directed towards one of the arms of the frame 12 and having a certain spacing therefrom. The limiting switches 36, 37 are actuated when the frame 12 is swung upwardly or downwardly out of the illustrated position. They are electrically connected to the gear motor 5 or to an intermediate circuit (not shown). The limiting switch 36 switches the gear motor 5 on and the limiting switch 37 switches it off again.

Thus, when the overlapping sacks are taken off the storage reel 10, its diameter decreases and the frame 12 is pushed upwardly by the piston-cylinder pressure unit 14 until the switch 36 is actuated. This starts the gear motor 5 which moves the arms 6, 7 to turn downwardly to the right-hand side and the frame is swung downwards against the force of the piston-cylinder pressure unit 14 until it reaches the limiting switch 37 which, when actuated, stops the gear motor 5. The spacing between the contact point of the storage reel 10 and the belts 21 and the pressure roller 33 thereby remains substantially constant, so that the sacks can be withdrawn from the storage reel 10 without difficulty even if the base of a sack of the withdrawn overlapping arrangement is stuck to the sacks still remaining on the storage reel 10 because the overlapping formation is constantly pressed by the pressure roller 33 against the belts 21 and taken along therewith.

Figure 2:
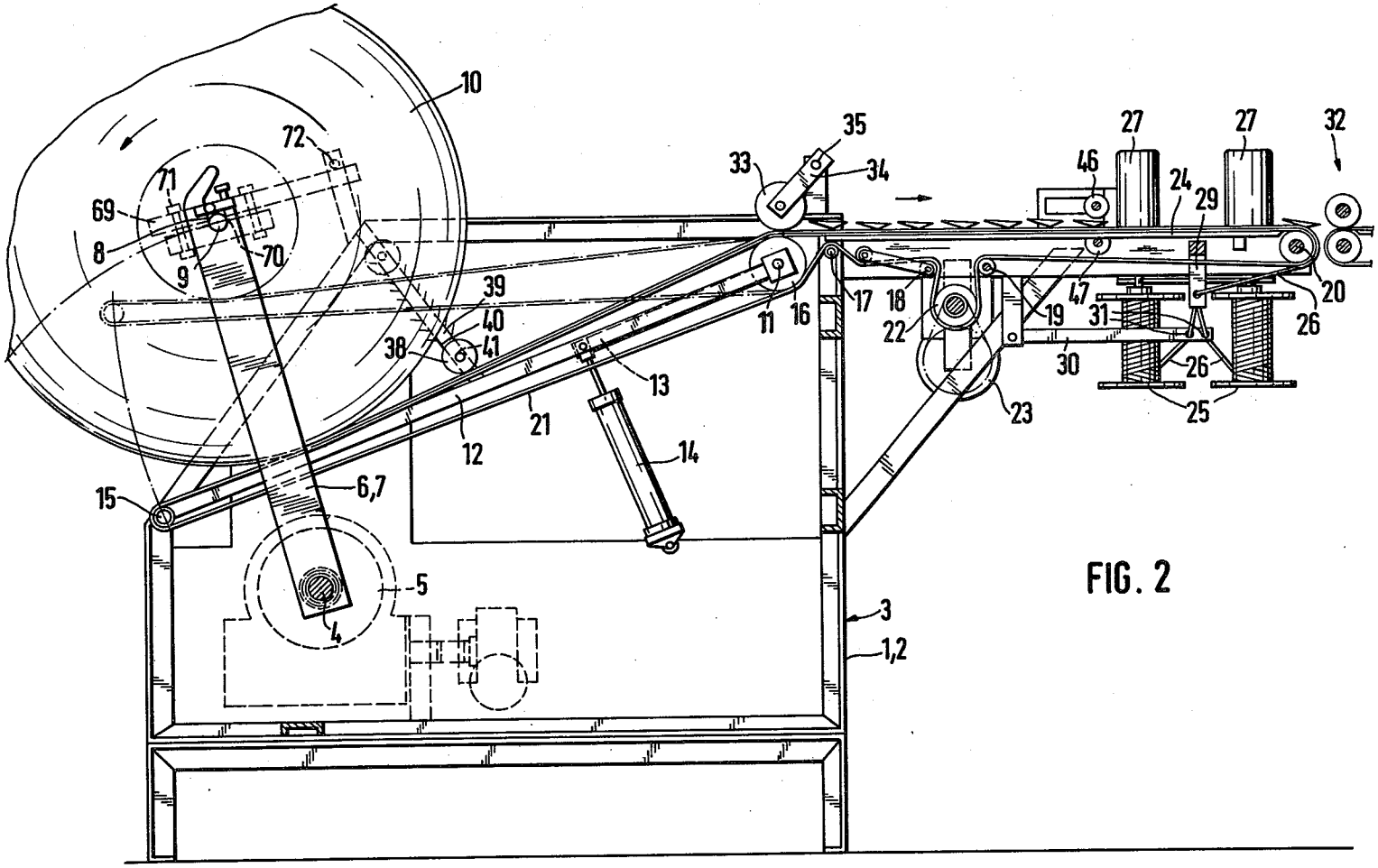
FIG. 2 is similar to FIG. 1 but showing a pressure roller guided in rectilinear guides that are fixed with respect to the stand.

In FIG. 2 the position of the storage reel 10 during withdrawal of the overlapping formation is held constant and a further pressure roller designated 38 moves parallel to itself together with the applying motion of the frame 12. For this purpose, guide tracks 39 which are fixed with respect to the stand are provided on both sides adjacent the frame 12 and in these slides 40 are readily slidably mounted. The slides 40 have holes 41 in which the journals of the pressure roller 38 are loosely rotatable. Upon a reduction in the diameter of the storage reel 10 during unreeling of the overlapping sacks, the frame 12 moves upwardly under the force of the piston-cylinder pressure unit 14. Together with this motion, the slides 40 move in their guide tracks 39 while the pressure roller 38 presses the overlapping sacks against the belts 21 under its own weight. With an appropriate inclination of the guide tracks 39 to the vertical, as will be seen in FIG. 2, the spacing of the point of contact between the storage reel 10 and that of the pressure roller 38 to the belts 21 remains practically the same.

Figure 3:
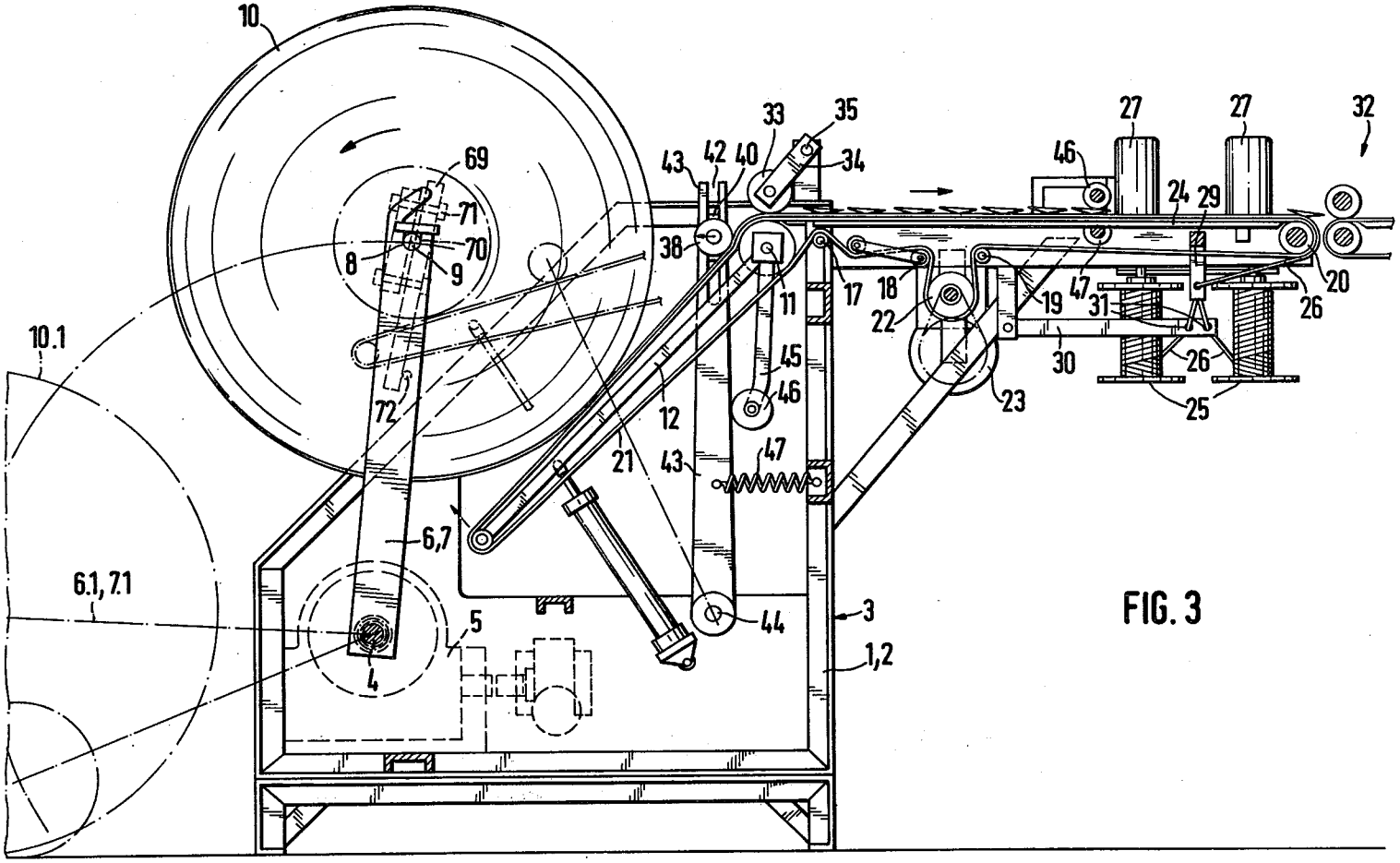
FIG. 3 is similar to FIG. 1 but showing guide tracks for the pressure roller that are mounted in pivotable levers.

According to FIG. 3, guide tracks designated 42 are mounted on levers 43 in which the slides 40 carrying the pressure roller 38 are slidingly mounted. The levers 43 are fixed to both sides on a shaft 44 which is loosely rotatably mounted at a position fixed with respect to the stand. They are pulled to the right by a spring 47 to a position that is favourable for offering a new storage reel 10. Fixed to both sides of the frame 12 or the shaft 11 there are drive levers 45 carrying rollers 46 at their free ends. The rollers 46 run up against the levers 43 and move these to turn to the left about the shaft 44 when the frame 12 gradually swings upwardly with a reduction in the diameter of the storage reel 10. The pressure roller 38 is thereby fed towards the storage reel 10 and the spacing of its contact points with the belts 21 is kept approximately constant.

We claim:

1. Apparatus for separating valved sacks stored in overlapping formation and held on reels by holding bands, the separated sacks being supplied to filling machines, said apparatus comprising a stand in which pivotable arms with bearings for receiving the reel are mounted, a frame which can be applied to the reel and carries at opposite ends rollers over which there pass driven endless belts pressing on the reel periphery to drive the reel, means for applying said frame to the reel, spools for coiling holding bands that are pulled off together with the unreeled overlapping sacks, conveyor means which are disposed downstream of the reel-driving belts, move at a higher speed and pull the sacks individually from the overlapping formation, roller means for pressing the overlapping sack formation against the endless belts and disposed at a spacing of no more than about one length of the sacks to be unreeled from the point where the overlapping sacks are just being lifted off the reel, and limiting switches mounted on said stand on opposite sides of one end of the frame carrying the rollers, the switching positions of the limiting switches being disposed in planes which keep the applying motion of said means for applying said frame within close limits.

2. Apparatus according to claim 1, characterised in that the storage reel is pivotable on the pivotable arms against the belts.

3. Apparatus for separating valved sacks stored in overlapping formation and held on reels by holding bands, the separated sacks being supplied to filling machines, said apparatus comprising a stand in which pivotable arms with bearings for receiving the reel are mounted, a frame which can be applied to the reel and carries at opposite ends rollers over which there pass driven endless belts pressing on the reel periphery to drive the reel, means for applying said frame to the reel, spools for coiling holding bands that are pulled off together with the unreeled overlapping sacks, conveyor means which are disposed downstream of the reel-driving belts, move at a higher speed and pull the sacks individually from the overlapping formation, and roller means for pressing the overlapping sack formation against the endless belts and disposed at a spacing of no more than about one length of the sacks to be unreeled from the point where the overlapping sacks are just being lifted off the reel, said means for pressing including a rotatable pressure roller having an axis parallel to the plane of said endless belts and mounted on said stand for translatory movement with respect to said endless belts.

4. Apparatus according to claim 3, characterised in that the pressure roller is mounted on guide carriages guided in guide tracks.

5. Apparatus according to claim 4, characterised in that the guide tracks are fixed with respect to the stand.

6. Apparatus according to claim 4, characterised in that the frame is applied to the stand by pivotal movement of the frame, and the guide tracks are connected to pivotable levers which are pivoted at positions fixed with respect to the stand and which are movable in dependence on the pivotal motion of the roller-carrying frame.

7. Apparatus according to claim 6, characterised in that driving levers connected to the roller-carrying frame lie against the pivotable levers.

* * * * *